US007029204B1

(12) United States Patent
Webber et al.

(10) Patent No.: US 7,029,204 B1
(45) Date of Patent: Apr. 18, 2006

(54) WALL LINING METHOD AND SYSTEM

(75) Inventors: Geoffrey Leigh Webber, Surrey (GB); Kevin Stuart Wilson, Oxon (GB); Ian Tupling, Cumbria (GB); Andrew George Hornung, West Yorkshire (GB); Robert Garratt, West Yorkshire (GB)

(73) Assignee: Cemex UK Operations Limited, Surrey (GB)

( * ) Notice: Subject to any disclaimer, the term of this patent is extended or adjusted under 35 U.S.C. 154(b) by 0 days.

(21) Appl. No.: 10/129,479

(22) PCT Filed: Nov. 3, 2000

(86) PCT No.: PCT/GB00/04238

§ 371 (c)(1),
(2), (4) Date: Sep. 16, 2002

(87) PCT Pub. No.: WO01/32993

PCT Pub. Date: May 10, 2001

(30) Foreign Application Priority Data

Nov. 5, 1999 (GB) ..... 9926300

(51) Int. Cl.
*E21B 20/02* (2006.01)
*E02D 17/20* (2006.01)

(52) U.S. Cl. ..... 405/129.8; 405/262

(58) Field of Classification Search ..... 405/262, 405/284, 285, 286, 129.8, 129.7, 129.6; 52/169.7
See application file for complete search history.

(56) References Cited

U.S. PATENT DOCUMENTS

| | | | | |
|---|---|---|---|---|
| 3,629,985 | A | 12/1971 | Ueno et al. | |
| 3,642,559 | A | 2/1972 | Stokes | |
| 3,686,873 | A * | 8/1972 | Vidal | 405/262 |
| 4,659,261 | A | 4/1987 | Chiaves | |
| 4,718,792 | A | 1/1988 | Louis | |
| 4,836,718 | A | 6/1989 | Deaton | |
| 4,911,582 | A * | 3/1990 | Peirce et al. | 405/262 |
| 5,002,436 | A | 3/1991 | Sigourney | |
| 6,053,662 | A * | 4/2000 | Scuero | 405/107 |
| 6,238,144 | B1 * | 5/2001 | Babcock | 405/284 |

FOREIGN PATENT DOCUMENTS

| | | |
|---|---|---|
| DE | 43 21 730 A1 | 1/1995 |
| EP | 0 922 810 A1 | 6/1999 |
| GB | 2 102 866 A | 2/1983 |
| JP | 4 102630 | 4/1992 |

* cited by examiner

*Primary Examiner*—Michael Safavi
*Assistant Examiner*—Gay Ann Spahn
(74) *Attorney, Agent, or Firm*—Kennedy Covington Lobdell & Hickman, LLP

(57) ABSTRACT

A method of lining a wall face comprises assembling a wall of concrete panels (16) close to the face to be lined, attaching the panels to the face to be lined by ground anchorages (12) pretensioned to provide the required resistance to hydrostatic pressure, the anchorages being grouted into the face at one end, and anchored to the respective panel at the other end, and filling the void between the wall and the face with free-draining material (14). The invention also relates to a system of lining a wall face using concrete panels and ground anchorages. Preferably the panels are cast in molds and have a synthetic low permeability sheet (29) incorporated into one or both sides of the panel during the casting process.

26 Claims, 4 Drawing Sheets

WALL LINING METHOD AND SYSTEM

BACKGROUND OF THE INVENTION

This invention relates to a wall lining method and system applicable, for example, for landfill sites.

As the availability of sites considered to be suitable to receive waste material reduces, there is a tendency to review sites which might have previously been rejected because of their difficult engineering requirements or their hydrogeological setting. Additionally, all new landfill sites which are to receive biodegradable waste require to be provided with a lining system which is engineered to control the ingress and egress of liquids and gases.

Known lining techniques can generally be adapted to deal with dry rock faces with varying degrees of reliability, but are, for example, unsuitable for deep, steep-sided rock faces, and many other potential applications, without losing an unsatisfactorily high portion of the void space.

SUMMARY OF THE INVENTION

An object of the invention is to provide a lining system which protects the sides of vertical or near-vertical rock faces and can also withstand significant hydrostatic pressures. The landfill lining may be employed above or below the water table.

The same system can also be used in other applications, for example, tank linings, earth-retaining structures or as reinforcement of an existing retaining wall.

According to the invention there is provided a method of lining a wall face comprising assembling a wall of concrete panels close to the face to be lined, attaching the panels to the face to be lined by ground anchorages pretensioned to provide the required resistance to hydrostatic pressure, the anchorages being grouted into the face at one end and anchored to the respective panel at the other end, and filling the void between the wall and the face with free-draining material.

The invention also provides a system of lining a wall face comprising a series of concrete panels assembled into a wall close to the face to be lined, and a plurality of ground anchorages attaching the wall panels to said face, the anchorages being pretensioned to provide the required resistance to hydrostatic pressure, and the void between the wall and the face being filled with free-draining material.

Preferably the concrete panels are assembled above a mass concrete foundation channel constructed adjacent the base of the face to be lined.

The panels are preferably cast in molds and have a synthetic, low permeability sheet (commonly referred to as a geomembrane) incorporated into one or both sides of the panel during the casting process.

Adjacent panels are preferably interlocking.

It is also preferred that the front face of the wall is finished flush and the low permeability sheets are welded together to form a continuous cover over the face of the wall.

The number of anchorages per square area may be progressively decreased upwards from the base of the wall.

The panels are manufactured with concrete preferably having a high compressive strength and low hydraulic conductivity.

BRIEF DESCRIPTION OF THE DRAWINGS

By way of example, a specific embodiment of a wall lining system in accordance with the invention will be described with reference to the accompanying drawings in which.

DETAILED DESCRIPTION OF THE PREFERRED EMBODIMENT

Figure 1:
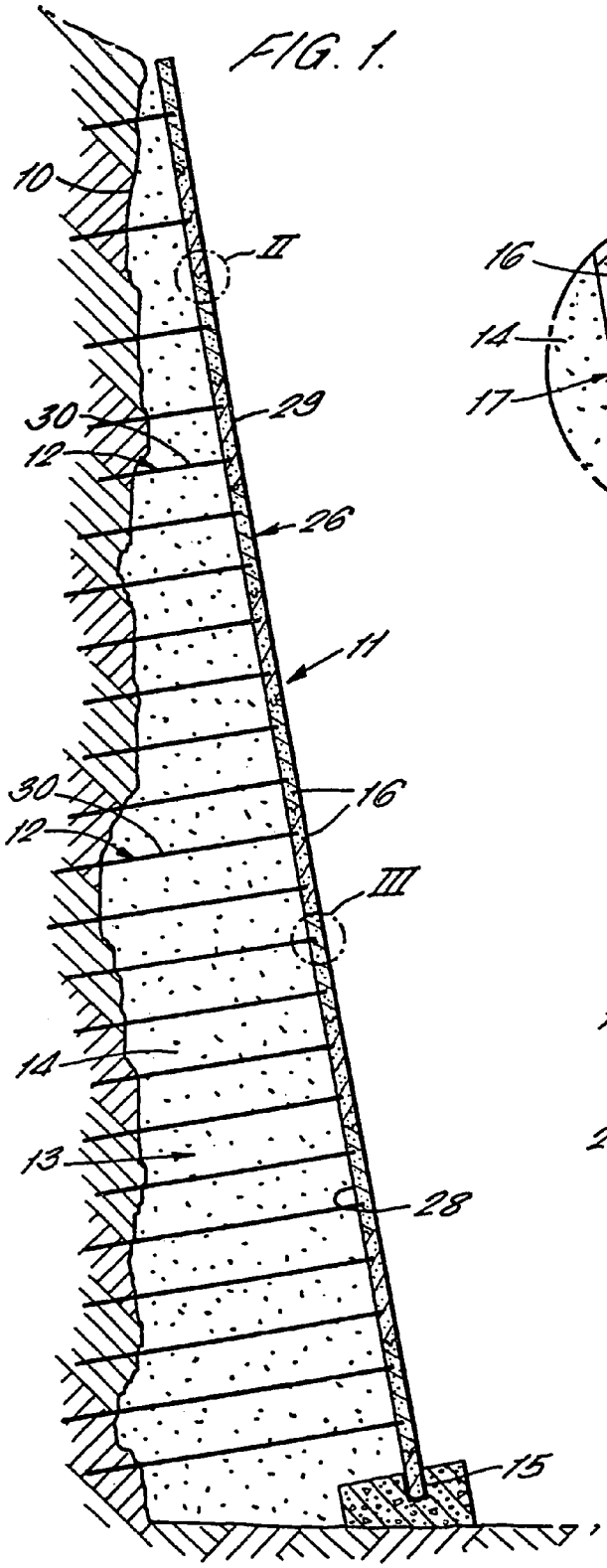
FIG. 1 shows a rock face with a protective wall lining of precast concrete panels constructed adjacent thereto and having ground anchorages diagrammatically shown attaching the wall panels to the rock face.

The illustrated embodiment concerns a system of wall lining an external substantially vertical rock face 10 of a landfill site, e.g. a quarry, in which it is envisaged that potentially high stresses will occur from water invasion between the rock face and the wall lining. These stresses may be reduced by pumping water away from behind the wall lining 11, either continuously or at intervals, but it is necessary that the wall lining can withstand the higher stresses which would result should the pumping equipment, if employed, be switched off or fail for any reason. For this purpose, the wall lining is tied to the rock face in close spaced relation by ground anchorages 12 which are pretensioned during construction of the wall lining to provide the required degree of resistance to hydrostatic pressure. The number and type of anchorages employed will depend on the geotechnical requirements and the ground pressure the wall lining is designed to withstand. If required, the number of anchorages per square area can be progressively decreased as the wall lining rises to allow for the lower/decreasing hydrostatic pressure which can be expected at higher levels. In the embodiment of FIG. 1, the anchorages are diagrammatically illustrated for clarity, showing, in side view, either two anchorages, one above the other, per panel 16 described below, or one anchorage per panel, for those panels higher up the wall lining. In practice, each panel will be manufactured for the attachment of the required number of anchorages, for example, between two and seven, for that particular panel, panels having a lesser number of anchorages being for higher up the wall lining. The void 13 between the rock face and the wall lining is filled with free draining material, e.g. granular material 14.

Adjacent to the base of the rock face there is constructed a mass concrete foundation channel 15 which provides for the initial alignment of the wall lining 11, its angle of inclination, and closeness relative to the rock face 10.

Figure 2:
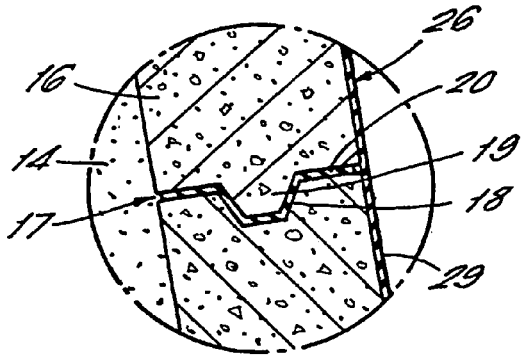
FIG. 2 is a detailed view taken at the dashed circle II of FIG. 1 of an interlocking joint between two adjacent wall panels.
Figure 4:
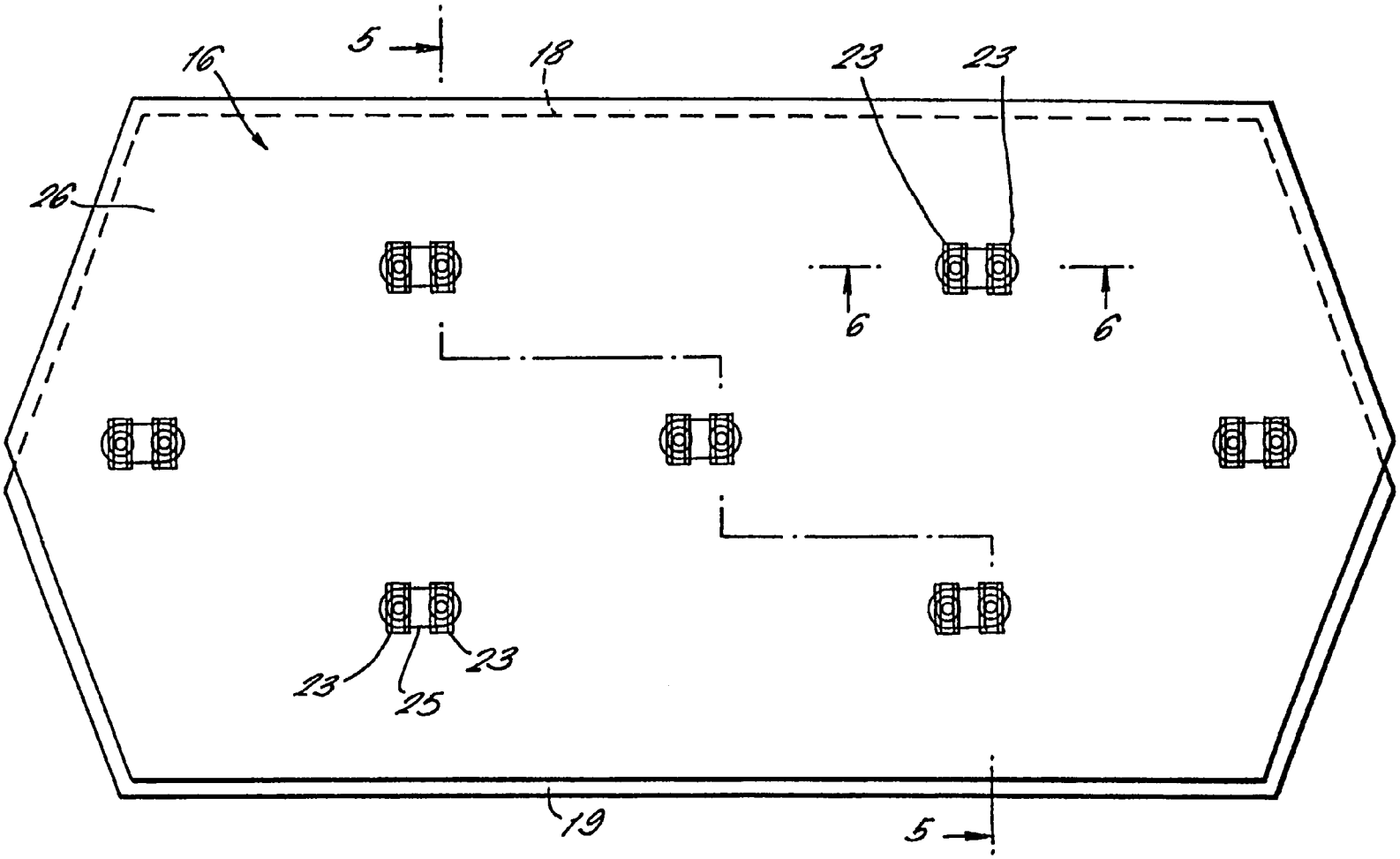
FIG. 4 is a plan view of one of the wall panels.
Figure 5:
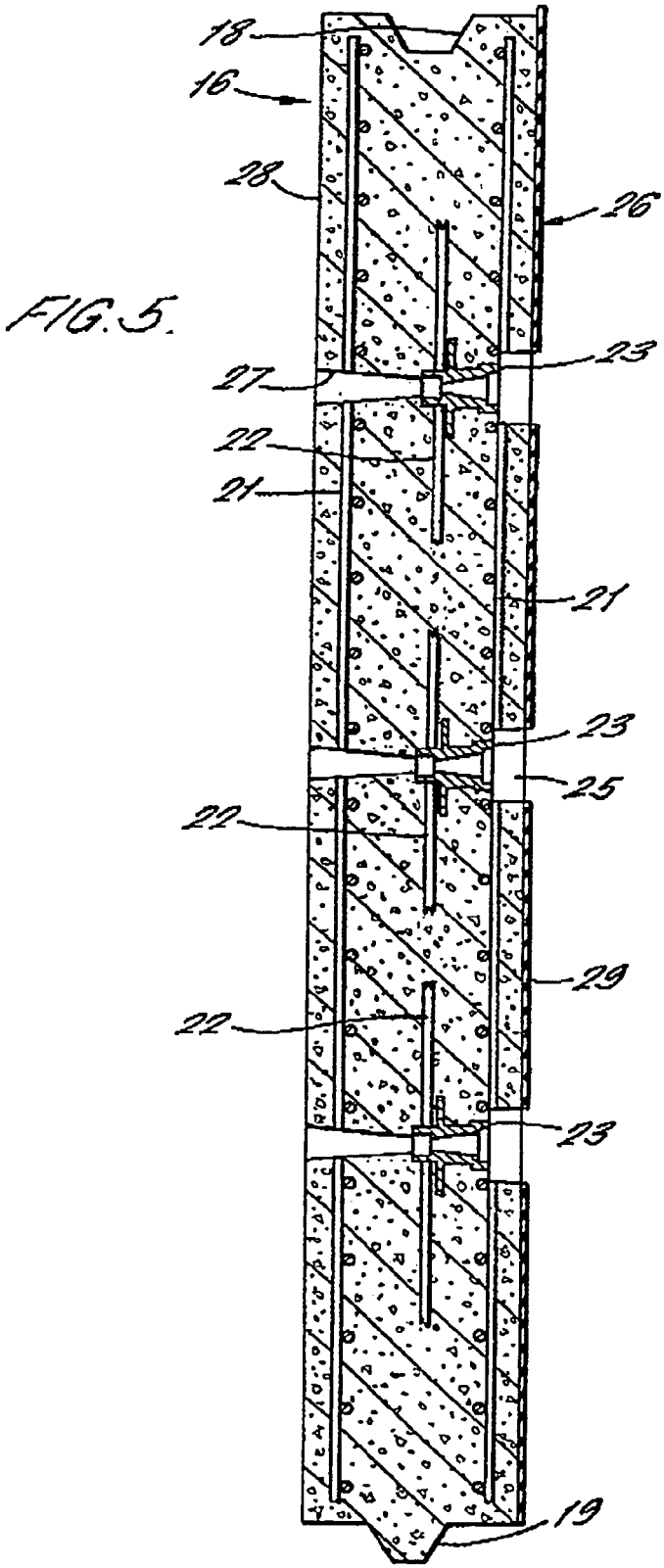
FIG. 5 is a section along line 5—5 in FIG. 4.
Figure 6:
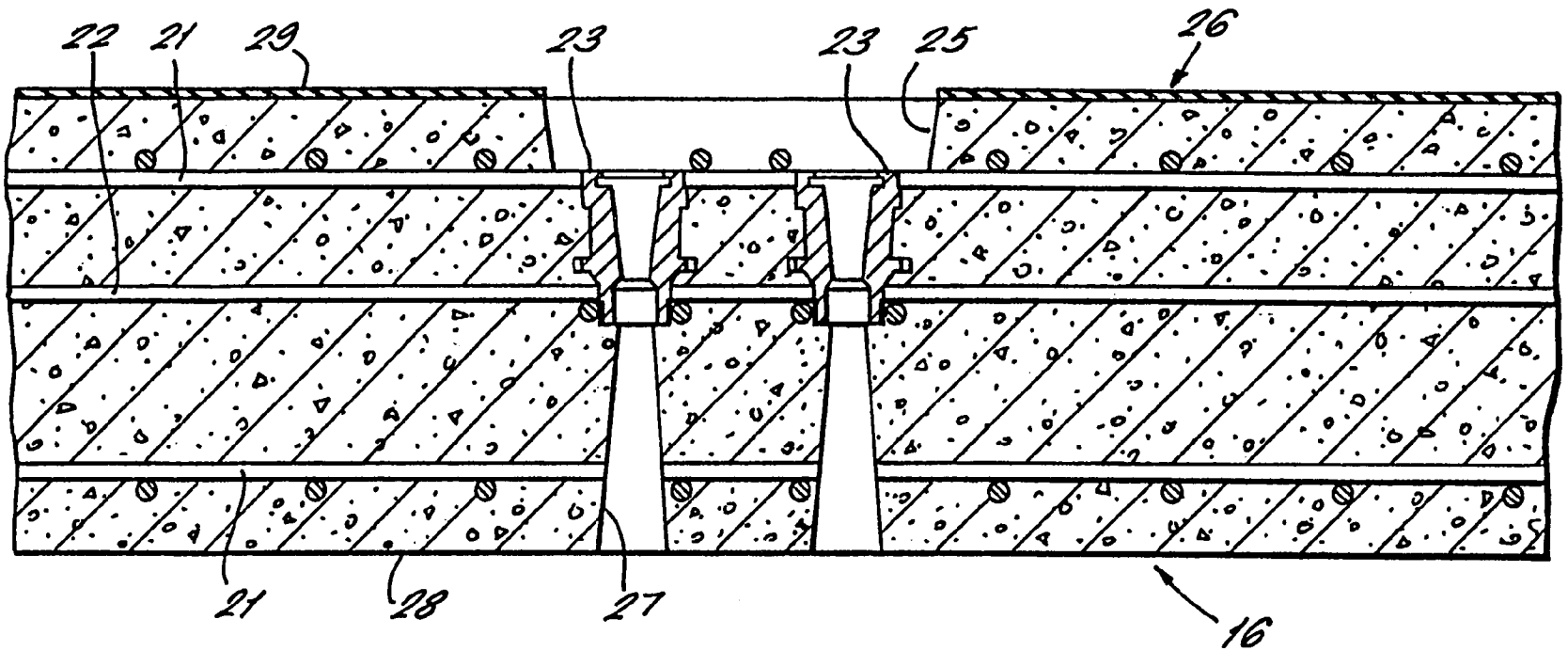
FIG. 6 is a partial section along line 6—6 in FIG. 4.

The wall lining comprises a series of interlocking panels 16, constructed of reinforced concrete assembled in horizontal rows, the lowermost row of panels being set and grouted into the foundation channel 15. Each panel (FIG. 4), in this embodiment, is an irregular hexagon measuring, for example, a nominal 4 meters horizontally×2 meters vertically. The upwardly facing edges have a groove 18 and the downwardly facing edges have a corresponding tongue 19 so that adjacent panels are interlocked. Within each joint 17, there is a proprietary strip or strips 20 of sealing material, e.g. bituminous tape, to provide a waterproofing seal (FIG. 2). Adjoining edges may also be grouted.

Each panel is cast in a mold and includes two layers of reinforcing mesh 21, two of which are shown, to meet the engineering requirements of each application. Between the layers of mesh are additional reinforcing bars 22 which provide support for anchor heads 23 for the desired number of ground anchorages 12. In the panel illustrated, there are seven pairs of heads 23, each pair being mounted below an open recess 25 in the upper surface 26 of the panel and aligned with a respective duct 27 leading to the lower surface 28 of the panel. As indicated above, different panels will have different arrangements of heads 23 depending on the number of ground anchorages required for that panel, there being one head for each anchorage to be attached to the panel. The concrete selected for this embodiment has a high compressive strength and low hydraulic conductivity.

During the casting process, there is set into the upper surface of the panel, a proprietary synthetic, low permeability sheet or geomembrane 29 of, for example, high density polyethylene as a primary seal for the wall lining. To suit different geotechnical requirements, it may be necessary to set a second low permeability sheet or geomembrane in the lower surface of the panel. The sealing strip or, strips 20 between adjacent panels 16 provide a secondary seal for the wall lining.

Each panel 16 is of sufficient thickness to ensure that the ducts 27, anchor heads 23, recesses 25 and lifting lugs (not shown) are incorporated within the panel during the casting process. The reinforcing mesh 21 is displaced or cut to avoid the anchor heads 23, ducts 27, and recesses 25. Likewise, the geomembrane 29 is cut around the recesses 25. The recesses 25 are of sufficient depth to accommodate the stressing heads used to pretension the ground anchorages 12, so that when the ground anchorages are stressed to the required extent there is no material left extending beyond the upper face 26 of the panel, which is the front face of the panel in use.

Figure 3:
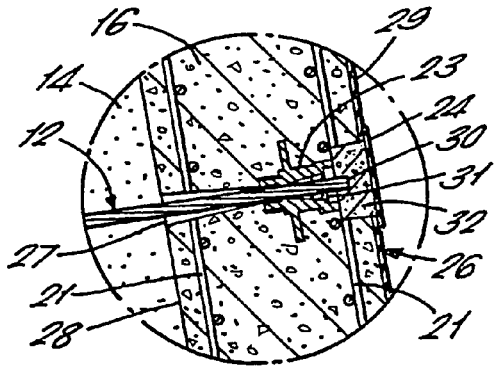
FIG. 3 is a detailed view taken at the dashed circle III of FIG. 1 showing the attachment of one of the ground anchorages within the respective wall panel.

The ground anchorages 12 comprise tendons 30 which at one end are grouted into pre-drilled holes aligned in the rock face 10. The tendon lengths which are of stranded cable, in this embodiment, are of variable dimensions and number of strands, depending on specific site conditions. The other ends of the tendons are threaded through respective ducts 27 in the panels 16 and each passes through the respective anchor head 23. For this purpose, the ducts 27 are preferably tapered longitudinally so that, at its inner extremity adjacent to the respective anchor head 23, each duct has an internal diameter which is equal to or just less than the bore of the anchor head. The tapered duct 27 thereby provides a lead-in for the tendon 30 into the anchor head 23. The tendons 30 are then stressed or tensioned to the required degree by a conventional hydraulically powered stressing head. The stressing head first takes up the slack in the tendon 30 and then gradually increases the applied tension to the required degree. The tendon is thereby pretensioned. Each tendon is then locked off by inserting a collect 31 or, if desired, a wedge into the respective anchor head 23 (FIG. 3). The stressing head can then be removed from the tendon, leaving the panel held rigidly in place. Excess tendon is removed so that it does not protrude beyond the front face of the panel. This prepares the anchor recess 25 to accept a seal.

When the panels 16 have been positioned and the anchorages 12 pretensioned, the geomembranes 29 on the exposed front faces of the panels are welded together to form a continuous lining on the face of the wall. Pre-cut patches 24 of geomembrane are partially welded over the anchor recesses 25 and the void beneath each patch is filled with grout 32. When the grout has set, the remainder of the patch is welded to complete the sealing of the wall. The grout or other suitable material is also used to seal the end of the tendon duct 27 on the rear face 28 of the panel 16.

The selection of a high compressive strength and low hydraulic conductivity concrete, together with the sealing strips 20 between the panels 16, creates a lining system in its own right. When combined with the continuous geomembrane 29, i.e. the low permeability sheets, extending over the front face of the wall lining, a composite liner is formed.

Whilst the wall lining system has been described in detail with reference to a rock face of a landfill site, the wall lining system can have other applications. For example, the system is applicable for use in tank linings, in earth-retaining structures, as a landfill lining both above and below the water table or as reinforcement of an existing retaining wall.

What is claimed is:

1. A method of lining a wall face of a landfill site comprising assembling a wall of concrete panels close to the face to be lined by ground anchorages pretensioned to provide the required resistance to hydrostatic pressure, the anchorages being grouted into the face at one end and anchored to the respective panel at the other end, and filling the void between the wall and the face with free-draining material, wherein the panels are cast in molds and have a synthetic low permeability sheet incorporated into one or both sides of the panel during the casting process, and the concrete panels are assembled above a mass concrete foundation channel constructed adjacent the base of the face to be lined.

2. A wall lining method as claimed in claim 1, wherein the front face of the wall is finished flush and the low permeability sheets are welded together to form a continuous cover over the face of the wall.

3. A wall lining method as claimed in claim 1, wherein the panels are constructed of reinforced concrete.

4. A wall lining method as claimed in claim 1, wherein each panel is interlocking with the adjacent panels.

5. A wall lining method as claimed in claim 1, wherein the wall comprises fixing members and said fixing members do not protrude beyond the front face of the concrete panel.

6. A wall lining method as claimed in claim 1, wherein the number of anchorages per square area is progressively decreased upwards from the base of the wall.

7. A wall lining method as claimed in claim 1, wherein sealing strips are interposed between the edges of adjacent panels.

8. A wall lining method as claimed in claim 1, wherein the panels are manufactured with concrete having a high compressive strength and low hydraulic conductivity.

9. A wall lining method as claimed in claim 1, wherein the face to be lined is the external wall of a landfill site.

10. A wall lining method as claimed in claim 1, wherein the face to be lined is the internal face of tank wall.

11. A wall lining method as claimed in claim 1, wherein the wall comprises an earth-retaining structure.

12. A wall lining method as claimed in claim 1, wherein the wall of concrete panels reinforces an existing retaining wall.

13. A system of lining a wall face of a landfill site comprising a series of concrete panels assembled into a wall close to the face to be lined, and a plurality of ground anchorages attaching the wall panels to said face, the anchorages being pretensioned to provide the required resistance to hydrostatic pressure, and the void between the wall and the face being filled with free-draining material, wherein the panels are cast in molds and have a synthetic low permeability sheet incorporated into one or both sides of the panel during the casting process, and the concrete panels are assembled above a mass concrete foundation channel constructed adjacent the base of the face to be lined.

14. A wall lining system as claimed in claim 13, wherein the front face of the wall is finished flush and the low permeability sheets are welded together to form a continuous cover over the face of the wall.

15. A wall lining system as claimed in claim 13, wherein the panels are constructed of reinforced concrete.

16. A wall lining system as claimed in claim 13, wherein each panel is interlocking with the adjacent panels.

17. A wall lining system as claimed in claim 13, wherein the wall comprises fixing members and said fixing members do not protrude beyond the front face of the concrete panel.

18. A wall lining system as claimed in claim 13, wherein the number of anchorages per square area is progressively decreased upwards from the base of the wall.

19. A wall lining system as claimed in claim 13, wherein sealing strips are interposed between the edges of adjacent panels.

20. A wall lining system as claimed in claim 13, wherein the panels are manufactured with concrete having a high compressive strength and low hydraulic conductivity.

21. A wall lining system as claimed in claim 13, wherein the face to be lined is the external wall of a landfill site.

22. A wall lining system as claimed in claim 13, wherein the face to be lined is the internal face of a tank wall.

23. A wall lining system as claimed in claim 13, wherein the wall comprises an earth-retaining structure.

24. A wall lining system as claimed in claim 13, wherein the wall of concrete panels reinforces an existing retaining wall.

25. A method of lining a wall face of a landfill site comprising assembling a wall of concrete panels close to the system face to be lined by ground anchorages pretensioned to provide the required resistance to hydrostatic pressure, the anchorages being grouted into the face at one end and anchored to the respective panel at the other end, and filling the void between the wall and the face with free-draining material, wherein the panels are cast in molds and have a synthetic low permeability sheet incorporated into one or both sides of the panel during the casting process, and each panel is an irregular hexagon.

26. A system of lining a wall face of a landfill site comprising a series of concrete panels assembled into a wall close to the face to be lined, and a plurality of ground anchorages attaching the wall panels to said face, the anchorages being pretensioned to provide the required resistance to hydrostatic pressure, and the void between the wall and the face being filled with free-draining material, wherein the panels are cast in molds and have a synthetic low permeability sheet incorporated into one or both sides of the panel during the casting process, and each panel is an irregular hexagon.

* * * * *